US012007136B2

(12) United States Patent
Kurihara et al.

(10) Patent No.: US 12,007,136 B2
(45) Date of Patent: Jun. 11, 2024

(54) AIR-CONDITIONING APPARATUS

(71) Applicant: Mitsubishi Electric Corporation, Tokyo (JP)

(72) Inventors: Makoto Kurihara, Tokyo (JP); Kosuke Sato, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 472 days.

(21) Appl. No.: 17/297,062

(22) PCT Filed: Feb. 18, 2019

(86) PCT No.: PCT/JP2019/005755

§ 371 (c)(1),
(2) Date: May 26, 2021

(87) PCT Pub. No.: WO2020/170289

PCT Pub. Date: Aug. 27, 2020

(65) Prior Publication Data

US 2022/0026097 A1 Jan. 27, 2022

(51) Int. Cl.
*F24F 11/50* (2018.01)
*F24F 11/66* (2018.01)
(Continued)

(52) U.S. Cl.
CPC ..... *F24F 11/66* (2018.01); *F24F 11/50* (2018.01); *F24F 11/79* (2018.01); *F24F 2110/10* (2018.01); *F24F 2120/10* (2018.01)

(58) Field of Classification Search
CPC ..... F24F 11/50; F24F 11/66; F24F 11/79
See application file for complete search history.

(56) References Cited

U.S. PATENT DOCUMENTS 10,115,029 B1 * 10/2018 Day ..... G06V 20/59
2010/0168923 A1 7/2010 Park et al.
(Continued)

FOREIGN PATENT DOCUMENTS

CN 107340062 A * 11/2017
DE 10 2014 009 414 A1 1/2016
(Continued)

OTHER PUBLICATIONS

International Search Report of the International Searching Authority mailed Mar. 12, 2019 for the corresponding international application No. PCT/JP2019/005755 (and English translation).
(Continued)

*Primary Examiner* — Mark A Connolly
(74) *Attorney, Agent, or Firm* — Posz Law Group, PLC

(57) ABSTRACT

An air-conditioning apparatus includes: a communication unit, a sensor, and a controller. The communication unit receives a radio signal from a portable terminal The sensor detects detailed information including information indicating presence or absence of a person in a detection target region that is a target region for detection of whether a person is present or not. The controller causes, when the communication unit receives a radio signal having a radio field intensity higher than or equal to a predetermined radio field intensity and a detection process by the sensor to detect the detailed information is in a stopped state, the sensor to start the detection process to detect the detailed information and control an air-conditioning operation based on the detailed information detected by the sensor.

16 Claims, 5 Drawing Sheets

(51) Int. Cl.

| | |
|---|---|
| ***F24F 11/79*** | (2018.01) |
| *F24F 110/10* | (2018.01) |
| *F24F 120/10* | (2018.01) |

(56) References Cited

U.S. PATENT DOCUMENTS

| | | | | |
|---|---|---|---|---|
| 2016/0341438 | A1 | 11/2016 | Yaegashi et al. | |
| 2018/0004178 | A1 | 1/2018 | Haines et al. | |
| 2018/0164840 | A1 | 6/2018 | Schwarz et al. | |
| 2020/0064011 | A1* | 2/2020 | Nakano | F24F 11/56 |

FOREIGN PATENT DOCUMENTS

| | | | |
|---|---|---|---|
| EP | 2 060 857 | B1 | 1/2019 |
| JP | 2003-219485 | A | 7/2003 |
| JP | 2011-112322 | A | 6/2011 |
| JP | 2016-095148 | A | 5/2016 |
| JP | 2016-192611 | A | 11/2016 |
| JP | 2017-075732 | A | 4/2017 |
| JP | 2018-146209 | A | 9/2018 |

OTHER PUBLICATIONS

Examination Report dated Apr. 8, 2022 issued in corresponding AU patent application No. 2019430531.
Office Action dated Mar. 5, 2024 issued in corresponding DE Patent Application No. 112019006880.6 (and English translation).

* cited by examiner

AIR-CONDITIONING APPARATUS

CROSS REFERENCE TO RELATED APPLICATION

This application is a U.S. national stage application of PCT/JP2019/005755 filed on Feb. 18, 2019, the contents of which are incorporated herein by reference.

TECHNICAL FIELD

The present disclosure relates to an air-conditioning apparatus provided with a wireless communication unit and a sensor.

BACKGROUND ART

As an existing air-conditioning apparatus, an air-conditioning apparatus is known that includes a radiative temperature sensor that detects a body surface temperature of a person in an air-conditioned space and air-conditions the space based on the result of detection by the radiative temperature sensor (see, for example, Patent Literature 1). In general, radiative temperature sensors absorb infrared rays emitted from a body surface of a person to detect a body surface temperature of the person. Thus, air-conditioning apparatuses can determine whether or not a person is present in the air-conditioned space by detecting infrared rays with the radiative temperature sensor.

CITATION LIST

Patent Literature

Patent Literature 1: Japanese Unexamined Patent Application Publication No. 2018-146209

SUMMARY OF INVENTION

Technical Problem

In many cases, a sensor that detects the presence of a person, such as a radiative temperature sensor, is operated at all times in order that an-air-conditioned space be comfortably air-conditioned based on whether a person or persons are present in the space or not. In such a manner, in the case where the sensor is in operation at all times, it is hard to increase the life of the sensor.

The present disclosure is applied to solve the above problem, and relates to an air-conditioning apparatus that includes a longer life sensor while ensuring that comfort is maintained.

Solution to Problem

An air-conditioning apparatus according to an embodiment of the present disclosure includes: a communication unit that receives a radio signal from a portable terminal; a sensor that detects detailed information including information indicating presence or absence of a person in a detection target region that is a target region for detection of whether a person is present or not; and a control unit that causes, when the communication unit receives a radio signal having a radio field intensity higher than or equal to a predetermined radio field intensity and a detection process by the sensor to detect the detailed information is in a stopped state, the sensor to start the detection process to detect the detailed information and control an air-conditioning operation based on the detailed information detected by the sensor.

Advantageous Effects of Invention

In the air-conditioning apparatus according to the embodiment of the present disclosure, in the case where the sensor is in a stopped state at the time of starting energization, and the communication unit receives a radio signal having a radio field intensity higher than or equal to the predetermined radio field intensity, the control unit causes the sensor to start the operation. Accordingly, it is possible to increase the life the sensor while ensuring that the comfort is maintained.

DESCRIPTION OF EMBODIMENTS

Embodiment

Figure 1:
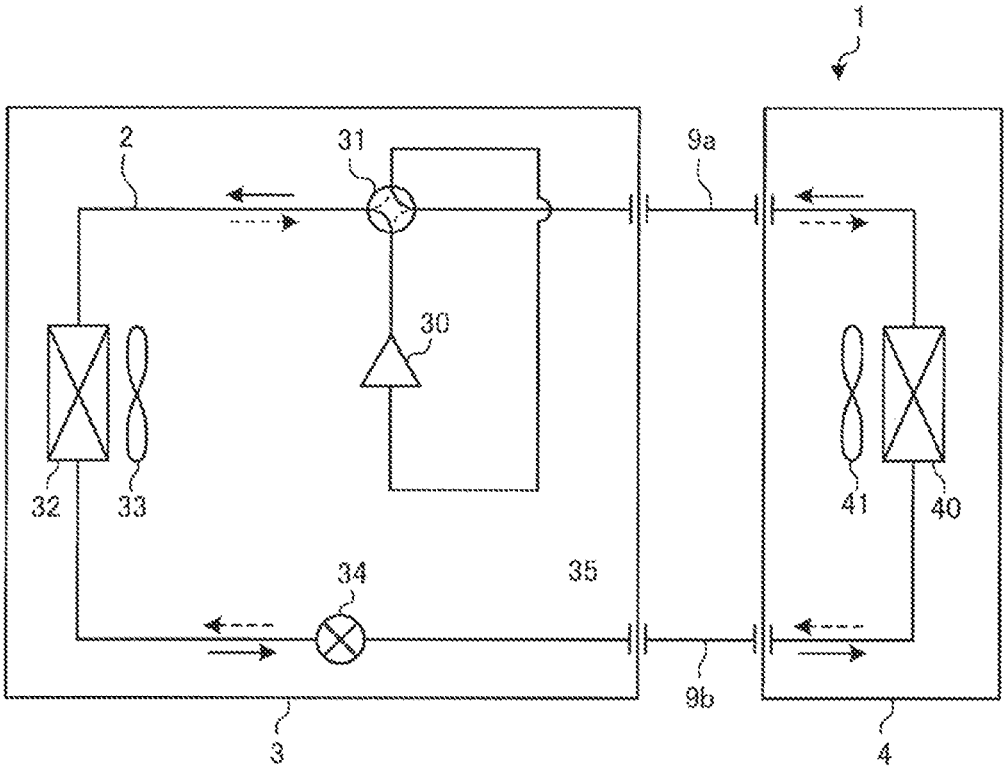
FIG. 1 is a schematic view illustrating an example of the configuration of an air-conditioning apparatus according to an embodiment of the present disclosure.
Figure 2:
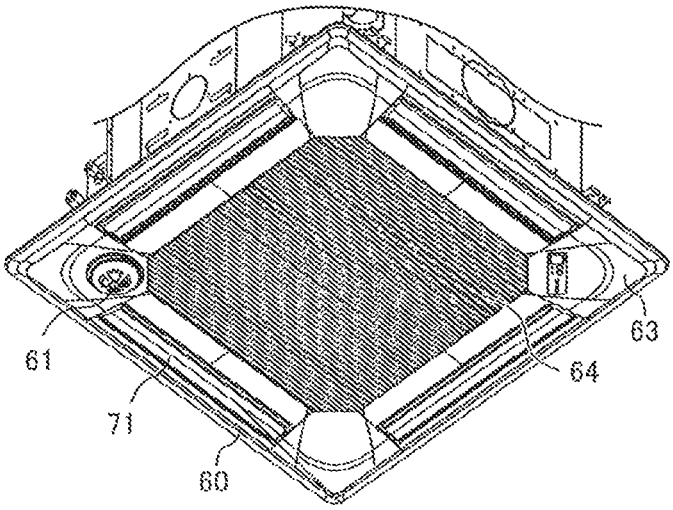
FIG. 2 is a perspective view of an indoor unit according to the embodiment of the present disclosure.
Figure 3:
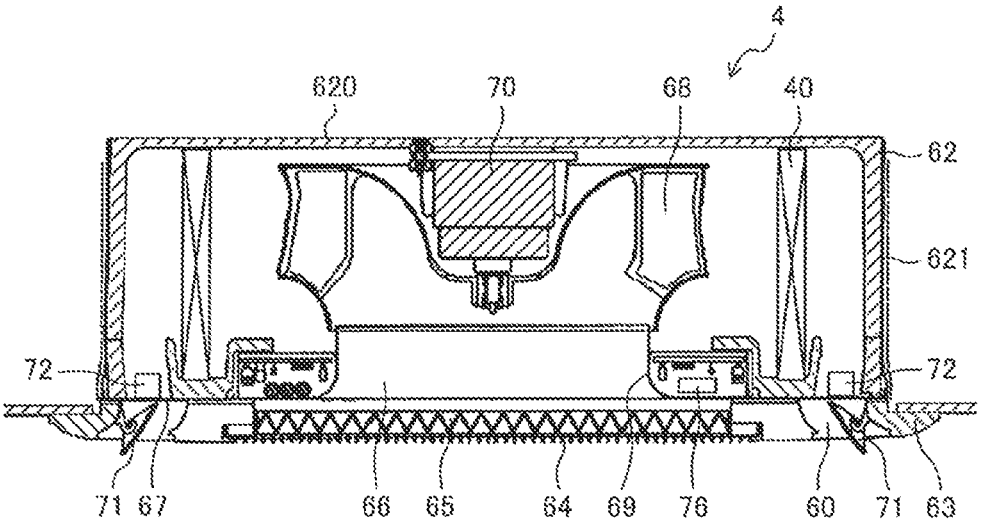
FIG. 3 is a schematic view of a vertical section of the indoor unit according to the embodiment of the present disclosure.

FIG. 1 is a schematic view illustrating an example of the configuration of an air-conditioning apparatus according to an embodiment of the present disclosure. An air-conditioning apparatus 1 is configured to cause refrigerant to circulate in a refrigerant circuit 2 and also causes heat exchange to be performed between the refrigerant and indoor air or outdoor air, to thereby air-condition an indoor space. The air-conditioning apparatus 1 includes an outdoor unit 3 and an indoor unit 4 along with the refrigerant circuit 2. In FIG. 1, of components included in the indoor unit 4, components related to circulation of the refrigerant are illustrated, and illustration of the other components is omitted. The components omitted in FIG. 1 are illustrated in FIGS. 2, 3, etc. and will be described in detail later.

The outdoor unit 3 and the indoor unit 4 are connected by refrigerant pipes 9*a* and 9*b* that are included in the refrigerant circuit 2. The outdoor unit 3 includes a compressor 30, a flow switching device 31, an outdoor heat exchanger 32, an outdoor fan 33, and an expansion valve 34.

The compressor 30 compresses sucked refrigerant and discharges the compressed refrigerant. The flow switching device 31 is, for example, a four-way valve and is a device configured to switch a flow passage for the refrigerant (which will be also referred to as refrigerant flow passage) between a plurality of refrigerant flow passages. The air-conditioning apparatus 1 can switch the operation from a heating operation to a cooling operation or from the heating operation to the cooling operation, using the flow switching device 31 to switch the refrigerant flow passage to be used. In FIG. 1, regarding the refrigerant flow passage in the flow switching device 31, solid lines indicate the refrigerant flow passage for the cooling operation, and dashed lines indicate the refrigerant flow passage for the heating operation. Similarly, in FIG. 1, solid arrows indicate the flow direction of the refrigerant during the cooling operation, and dashed arrows indicate the flow direction of the refrigerant during the heating operation.

The outdoor heat exchanger 32 causes heat exchange to be performed between the refrigerant and outdoor air. During the cooling operation, the outdoor heat exchanger 32 operates as a condenser. To be more specific, the outdoor heat exchanger 32 causes heat exchange to be performed between outdoor air and the refrigerant that flows from the flow switching device 31 through the refrigerant pipe 9*a* into the compressor 30 and is then compressed by the compressor 30, thereby condensing and liquefying the refrigerant. Then, the outdoor heat exchanger 32 causes the liquefied refrigerant to flow out to the refrigerant pipe 9*b*. During the heating operation, the outdoor heat exchanger 32 operates as an evaporator. To be more specific, the outdoor heat exchanger 32 causes heat exchange to be performed between outdoor air and the refrigerant that flows from the refrigerant pipe 9*b* into the expansion valve 34 and is then reduced in pressure by the expansion valve 34, thereby evaporating and gasifying the refrigerant. The outdoor heat exchanger 32 causes the gasified refrigerant to flow out to the refrigerant pipe 9*a*.

The outdoor fan 33 sends the outdoor air to the outdoor heat exchanger 32 to improve the efficiency of heat exchange between the air and the refrigerant. The expansion valve 34 is an expansion device that regulates the pressure of the refrigerant by changing the opening degree of the expansion valve 34 to regulate the flow rate of the refrigerant that flows through the expansion valve 34.

The indoor unit 4 includes an indoor heat exchanger 40 and a fan 41. The indoor heat exchanger 40 causes heat exchange to be performed between refrigerant and indoor air. During the cooling operation, the indoor heat exchanger 40 operates as an evaporator, To be more specific, the indoor heat exchanger 40 cause heat exchange to be performed between indoor air and refrigerant that is made to be in a low-pressure state by the expansion valve 34, whereby the refrigerant receives heat from the indoor air to evaporate and gasify the indoor air. The indoor heat exchanger 40 causes the gasified refrigerant to flow out to the refrigerant pipe 9*a*. By contrast, during the heating operation, the indoor heat exchanger 40 operates as a condenser. To be more specific, the indoor heat exchanger 40 causes heat exchange to be performed between indoor air and refrigerant that flows from the refrigerant pipe 9*a* to condense and liquefy the refrigerant. The indoor heat exchanger 40 causes the liquefied refrigerant to flow out to the refrigerant pipe 9*b*. The fan 41 sends the indoor air to the indoor heat exchanger 40 to improve the efficiency of heat exchange between the air and the refrigerant.

FIG. 2 is a perspective view of an indoor unit according to the embodiment of the present disclosure. The indoor unit 4 according to the embodiment is of a ceiling concealed type, and is also a 4-way cassette type indoor unit provided with air outlets 60 that faces in four directions. However, the type of the indoor unit 4 is not limited to the above type. The indoor unit 4 includes a radiative temperature sensor 61 that detects, for example, a temperature distribution of an indoor space and whether a person is present in the indoor space or not. The radiative temperature sensor 61 is located on a side of the indoor unit 4 that faces the indoor space.

FIG. 3 is a schematic view of a vertical section of the indoor unit according to the embodiment of the present disclosure. With reference to FIGS. 2 and 3, a configuration of the indoor unit 4 will be described below. The indoor unit 4 has a housing 62 that includes a top panel 620 and side panels 621. The indoor unit 4 is installed such that the top panel 620 is embedded in a ceiling of a room and faces upward in a vertical direction. The housing 62 has an opening at a side that faces the indoor space. A decorative panel 63 having a substantially quadrilateral shape as viewed in planar view is attached to the side of the indoor unit 4 that faces the indoor space.

The indoor unit 4 includes a grille 64 that serves as an inlet to suck air into the indoor unit 4 and a filter 65 that removes dust from air that has passed through the grille 64. Furthermore, the indoor unit 4 has a body air inlet 66 that serves as a passage through which the air flows into a body of the indoor unit. Also, a body air outlet 67 is provided around the body air inlet 66 of the indoor unit 4 and is an opening portion through which air flows out from the inside of the body. The grille 64, the body air inlet 66, the body air outlet 67, and the air outlets 60 communicate with each other, thereby forming an air flow passage in the indoor unit 4.

In the indoor unit 4, a turbofan 68, a bell mouth 69, a fan motor 70, the indoor heat exchanger 40, and a controller 76 are provided in the body of the indoor unit 4. The turbofan 68 is an example of the fan 41 as illustrated in FIG. 1 and is a centrifugal fan whose rotating shaft is provided to extend in the vertical direction. The turbofan 68 sends air sucked through the grille 64 in a horizontal direction and a direction away from the rotating shaft of the turbofan 68. In other words, the turbofan 68 guides the air along the air flow passage formed by the grille 64, the body air inlet 66, the body air outlet 67, and the air outlets 60. It should be noted that as the fan 41, for example, a sirocco fan or a radial fan may be used. The bell mouth 69 forms part of the air flow passage for the air guided to the inside by the turbofan 68, and rectifies the air. The fan motor 70 rotates the turbofan 68 by driving the turbofan 68. The indoor heat exchanger 40 is, for example, a finned tube heat exchanger, and is provided downstream of the turbofan 68 in the air flow passage in such a way as to surround the turbofan 68.

The air outlets 60 are formed to extend along respective sides of the decorative panel 63. At the air outlets 60, respective vertical wind direction control plates 71 are provided. Each of the vertical wind direction control plates 71 controls the angle of the flow direction of wind that is blown from the indoor unit 4, relative to a floor surface. Furthermore, at the air outlets 60, respective lateral wind direction control plates 72 are provided. The lateral wind direction control plates 72 are located inward of the respective vertical wind direction control plates 71 in the indoor unit 4 and are configured to control the flow direction of wind that is blown from the indoor unit 4, in a direction parallel to the floor surface. The indoor unit 4 includes a vertical wind direction control motor 73 (see FIG. 6) that drives the vertical wind direction control plates 71 and a lateral wind direction control motor 74 (see FIG. 6) that drives the lateral wind direction control plates 72.

The controller 76 controls components of the outdoor unit 3, for example, the compressor 30 and the outdoor fan 33, and components of the indoor unit 4, for example, the fan motor 70, the vertical wind direction control motor 73, and the lateral wind direction control motor 74, to thereby control an air-conditioning operation of the air-conditioning apparatus 1. Also, the controller 76 controls the radiative temperature sensor 61, which will be described in detail below. The controller 76 includes a processor such as a central processing unit (CPU) or a micro processing unit (MPU) and a memory such as a read only memory (ROM) or a random access memory (RAM). When the processor reads and executes a program from various programs stored in the memory, a control operation by the controller 76 is performed. Alternatively, as the entire controller 76 or part of the controller 76, dedicated hardware designed to control components to be controlled may be used. The controller 76 will be described in detail later.

The radiative temperature sensor 61 includes an infrared ray sensor that detects infrared rays and is rotated by a motor (not illustrated) to scan a space that is air-conditioned (also referred to as an air-conditioned space). The radiative temperature sensor 61 detects infrared rays emitted at a region to be scanned, to thereby detect a temperature distribution in the region. In the case where a person is present in the region to be scanned by the radiative temperature sensor 61, the radiative temperature sensor 61 detects the presence and position of the person from infrared rays emitted from a body of the person. Such a region to be scanned to detect whether a person is present in the region or not will also be referred to as a detection target region α. The region that is scanned by the radiative temperature sensor 61 is an example of the detection target region α. Information that indicates a temperature distribution of the detection target region α that is scanned by the radiative temperature sensor 61 whether a person or persons are present or absent in the detection target region α, and the position of a person or persons who are present in the detection target region α will also be hereinafter referred to as detailed information.

Figure 4:
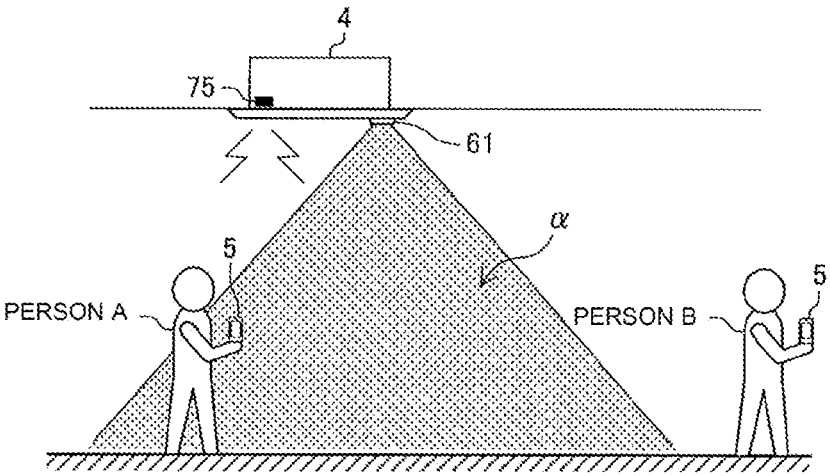
FIG. 4 illustrates an example of a target to be detected by a radiative temperature sensor in the embodiment of the present disclosure.

The detection target region α to be scanned by the radiative temperature sensor 61 will be described. FIG. 4 illustrates an example of a target to be detected by a radiative temperature sensor in the embodiment of the present disclosure. In FIG. 4, the detection target region α to be scanned by the radiative temperature sensor 61 is a hatched region. When a person is present in the detection target region α, the radiative temperature sensor 61 detects the presence and position of the person. Referring to FIG. 4, the radiative temperature sensor 61 detects the presence and position of a person A who is present in the detection target region α, but does not detect a person B who is not present in the detection target region α.

Figure 5:
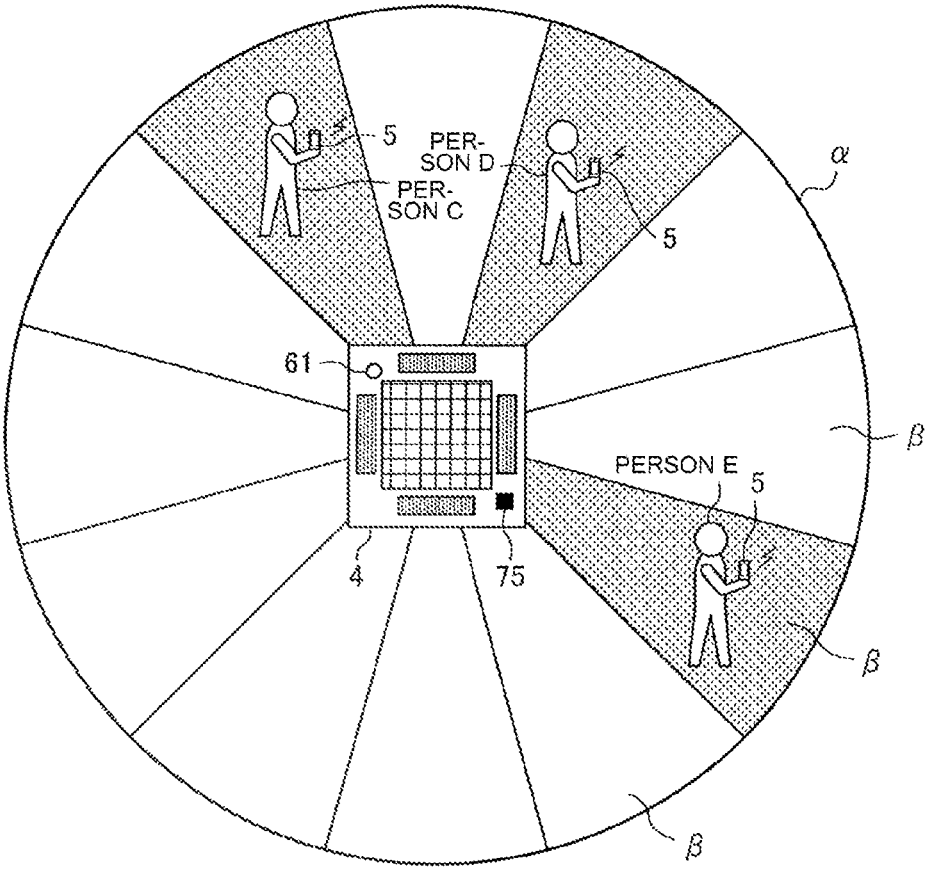
FIG. 5 illustrates an example of a detection target region in a horizontal plane that is to be detected by the radiative temperature sensor.

FIG. 5 illustrates an example of a detection target region in a horizontal plane that is to be scanned by the radiative temperature sensor. It should be noted that the horizontal plane means a floor surface or a surface parallel to the floor surface. In the embodiment of the present disclosure, the detection target region α in the horizontal plane is a region surrounded by a circle that has a given radius from a position in the horizontal plane that corresponds to a position at the ceiling where the indoor unit 4 is installed.

Referring to FIG. 5, a person C, a person D, and a person E are present in the detection target region α. The radiative temperature sensor 61 may detect two-dimensional coordinates in the horizontal plane or three-dimensional coordinates in a space to detect the positions of the persons. The two-dimensional coordinates may be coordinates in a two-dimensional orthogonal system that includes two orthogonal axes in the horizontal plane or may be coordinates in a polar coordinate system that has a point of origin at a center of a circle that is the outline of the detection target region α. The three-dimensional coordinates may be coordinates in a three-dimensional orthogonal system that includes two orthogonal axes in the horizontal plane and an axis orthogonal to the axes and parallel to a height direction from the floor. Alternatively, the radiative temperature sensor 61 may detect which region or regions in the detection target region α a person or persons are present in, in addition to coordinates.

In a polar coordinate system that has a point of origin at the center of a circle that is the outline of the detection target region α in the horizontal plane, regarding a plurality of small areas β into which the detection target region α is divided by a given angle in an azimuthal direction, the radiative temperature sensor 61 detects which one or ones of the plurality of small areas β a person or persons are present in. Referring to FIG. 5, the person C, the person D, and the person E are present in three hatched small areas β. When the radiative temperature sensor 61 detects the person C, the person D, and the person E, the air-conditioning apparatus 1 performs an air-condition operation depending on the positions of the persons.

The radiative temperature sensor 61 is an example of a sensor that detects the presence and position of a person. As such a sensor, a camera that includes an image sensor such as a charge-coupled device (CCD) sensor or a complementary metal-oxide-semiconductor (CMOS) sensor may be used.

It should be noted that existing radiative temperature sensors perform an operation to detect, for example, the presence and position of a person and a temperature distribution even when no person is present in the detection target region α, as a result of which power is wastefully consumed, and deterioration of the radiative temperature sensor 61 easily progresses However, in the case where a person is present in the detection target region α, when the radiative temperature sensor 61 is in stopped state, there is a possibility that the comfort level of the person in the air-conditioned space will be reduced. The air-conditioning apparatus 1 according to the embodiment of the present disclosure includes components described below to achieve both a longer life of the radiative temperature sensor 61 and improvement of the comfort level of the person who is present in the air-conditioned space.

Figure 6:
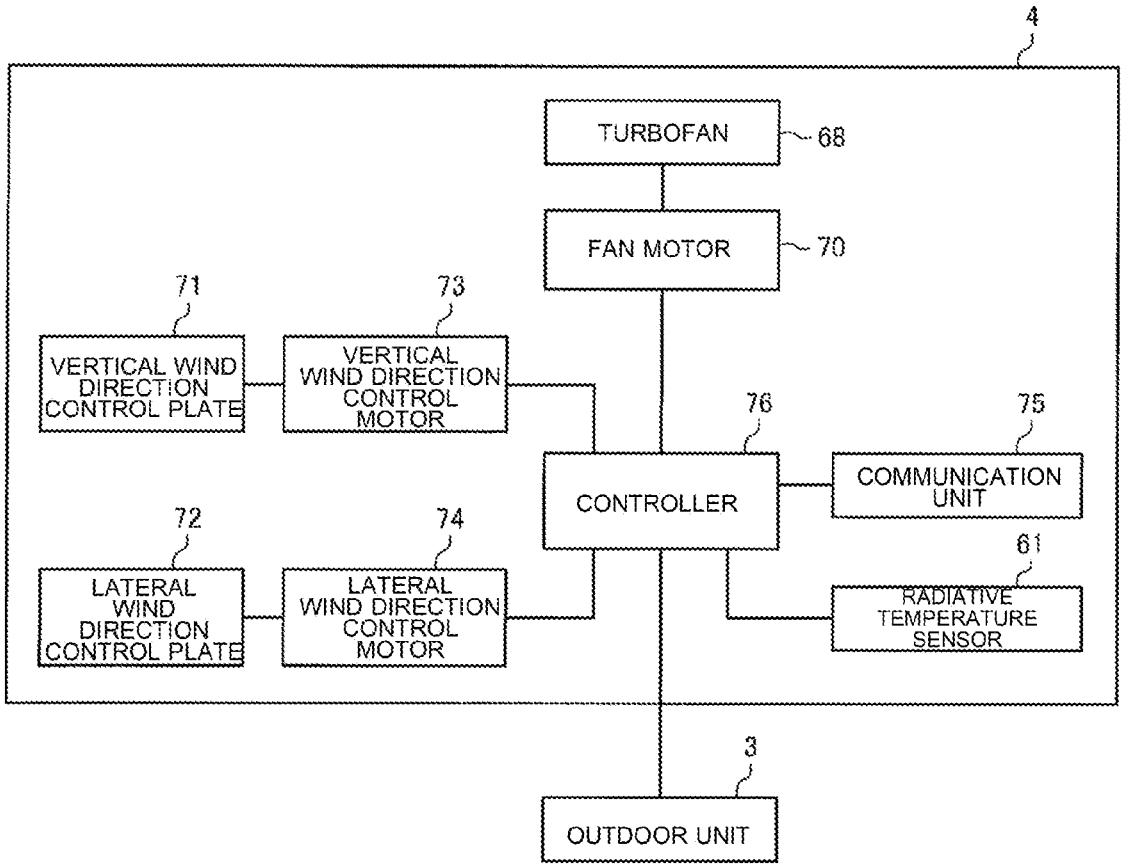
FIG. 6 is a block diagram of the indoor unit according to the embodiment of the present disclosure.

FIG. 6 is a block diagram of the indoor unit according to the embodiment of the present disclosure. It should be noted that in FIG. 6, illustrations of the air outlets 60, the housing 62, etc., are omitted in order that the configuration be easily understood. In FIG. 6, as described above, the indoor unit 4 includes the radiative temperature sensor 61, the turbofan 68, the fan motor 70, the vertical wind direction control plates 71, the lateral wind direction control plates 72, the vertical wind direction control motor 73, the lateral wind direction control motor 74, and the controller 76. In the embodiment of the present disclosure, the indoor unit 4 further includes a communication unit 75 that wirelessly communicates with a portable terminal 5 (see FIGS. 4 and 5). The portable terminal 5 is, for example, a smart phone, a cellular phone, or a tablet-type terminal.

The communication unit 75 includes a communication interface and a radio field intensity measuring device. The communication unit 75 conforms to, for example, standards for a wireless personal area network (PAN) such as Bluetooth (registered trademark) or ZigBee (registered trademark) and wirelessly communicates with the portable terminal 5 as Near Field communication. The communication unit 75 may conform to standards for a wireless local area network (WLAN) such as Wi-Fi (registered trademark) to wirelessly communicate with the portable terminal 5. When receiving a radio signal, the communication unit 75 measures a radio field intensity of the radio signal, and notifies the controller 76 of the measured radio field intensity. The longer the distance between a transmission side that transmits the radio signal and the communication unit 75, the lower the intensity of the radio signal.

The controller 76 will be described. The controller 76 controls the radiative temperature sensor 61 and causes the radiative temperature sensor 61 to be in operation or in the stopped state in accordance with conditions. It is assumed that "stopped state" also covers "standby" state. Based on the radio field intensity of a radio signal sent from the portable terminal 5, the controller 76 determines whether a person is present in the detection target region α or not. Based on the result of the above determination, the controller 76 controls the radiative temperature sensor 61. It should be noted that at the starting point of energization of the air-conditioning apparatus 1, the radiative temperature sensor 61 is in the stopped state.

The controller 76 determines whether or not the radio field intensity of the radio signal received by the communication unit 75 is higher than or equal to a predetermined radio field intensity. The predetermined radio field intensity is a criterion intensity indicating whether or not a person is present in the detection target region α, and the value of the predetermined radio field intensity is determined as appropriate. For instance, in the case where the air-conditioning apparatus 1 is installed at the center of a ceiling of a room that is an air-conditioned space, the predetermined radio field intensity may be, for example, the lowest one of radio field intensities of radio signals that are sent from a portable terminal 5 held by a person who is present in the detection target region α. In this case, referring to FIG. 4, the radio field intensity of a radio signal from the portable terminal 5 held by the person A is higher than or equal to the predetermined radio field intensity, and the radio field intensity of a radio signal from the portable terminal 5 held by the person B is less than the predetermined radio field intensity.

When the radio field intensity of a radio signal received by the communication unit is higher than or equal to the predetermined radio field intensity, the controller 76 causes the radiative temperature sensor 61 that is in the stopped state to start to perform an operation of the radiative temperature sensor 61. When the communication unit does not receive a radio signal of a radio field intensity higher than or equal to the predetermined radio field intensity, and the radiative temperature sensor 61 is in the stopped state, the controller 76 does not cause the radiative temperature sensor 61 to start to perform the operation.

When the radio field intensity of a radio signal received by the communication unit 75 is higher than or equal to the predetermined radio field intensity, and the radiative temperature sensor 61 that starts to operate in response to an instruction from the controller 76 detects the presence and position of a person, the controller 76 acquires detailed information from the radiative temperature sensor 61. In the embodiment of the present disclosure, each time the radiative temperature sensor 61 detects detailed information, the detailed information is sent from the radiative temperature sensor 61 to the controller 76, whereby the controller 76 acquires the detailed information. However, the acquisition of detailed information by the controller 76 is not limited to the above example. In order that the controller acquire detailed information, detailed information may be sent periodically from the radiative temperature sensor 61, or the controller 76 may instruct the radiative temperature sensor 61 to output detailed information.

The controller 76 controls the air-conditioning operation of the air-conditioning apparatus 1 based on the detailed information. In the embodiment, the controller 76, controls the vertical wind direction control motor 73 and the lateral wind direction control motor 74 based on the detailed information to adjust orientations of the vertical wind direction control plates 71 and the lateral wind direction control plates 72 and control the flow direction of wind that is blown out from each of the air outlets 60.

The way to control the wind direction will be specifically described with reference to FIG. 5. In the detection target region α as illustrated in FIG. 5, persons C, D, and E are present in respective hatched small areas β and have respective portable terminals 5. The communication unit 75 receives radio signals having radio field intensities that are higher than or equal to the predetermined radio field intensity. Thus, the radiative temperature sensor 61 is made to be in operation and detects the presence of the persons in the hatched small areas β.

The controller 76 acquires from the radiative temperature sensor 61, detailed information that includes information indicating the presence of the persons (the persons C, D, and E) and information indicating the small areas β where the persons are present. The controller 76 controls, based on the situation, the air-conditioning apparatus to send air to the three small areas β where the persons are present. Alternatively, the controller 76 controls, based on the situation, the air-conditioning apparatus not to send air to the three small areas β where the persons are present. The above "situation" means a situation in which the temperature in each of the small areas β is high or low, or means, for example, an operational state of the air-conditioning apparatus 1. The operational state is, for example, a state in which the air-conditioning apparatus 1 is in heating operation or in cooling operation. Furthermore, the operational state is, for example, a state in which components of the air-conditioning apparatus 1, such as the compressor 30, the outdoor heat exchanger 32, and the indoor heat exchanger 40, are in operation or a state in which at least one of these components is not in operation.

When components such as the outdoor heat exchanger 32 and the indoor heat exchanger 40 are in operation, for example, and heat exchange is performed between air and the refrigerant, if the temperature in a small area β where a person is present does no reach a set temperature, the controller 76 controls the air-conditioning apparatus to send air to the small area β. Under such a control, the vertical wind direction control motor 73 and the lateral wind direction control motor 74 drive the vertical wind direction control plates 71 and the lateral wind direction control plates 72, respectively, to cause wind to be blown out to the small area β where the person is present. For example, when the air-conditioning apparatus 1 is made to be in heating operation by a user's setting, for example, if the outdoor heat exchanger 32 or the indoor heat exchanger 40 is not in operation, and as a result, heat exchange is not performed between air and the refrigerant, the controller 76 may control the air-conditioning apparatus not to send wind to the small area β where the person is present. Under such a control, the vertical wind direction control motor 73 and the lateral wind direction control motor 74 drive the vertical wind direction control plates 71 and the lateral wind direction control plates 72, respectively, to prevent wind from being blown out to the small area β where the person is present.

The controller 76 may adjust the strength of wind that is blown out from the air outlets 60, by controlling the rotation speed of the fan motor 70 based on detailed information to control the rotation speed of the turbofan 68.

The controller 76 may perform a control for adjustment of the temperature using at least one of a radio signal received by the communication unit 75 and detailed information detected by the radiative temperature sensor 61. This control will be described below. The controller 76 can estimate the number of persons in the detection target region α based on a specific address of a portable terminal 5 or specific addresses of portable terminal or terminals 5, such as Internet Protocol (IP) address or addresses or media access control (MAC) address or addresses, that are contained in a radio signal or signals received by the communication unit 75. To be more specific, the controller 76 can estimate the number of persons in the detection target region α by ascertaining how many radio signals are received by the communication unit 7. In this case, the radio signals are radio signals that have radio field intensities higher than or equal to the predetermined radio field intensity and that include different addresses. The address is an example of an identifier that is included in a radio signal and uniquely assigned to a portable terminal 5, which is a transmission side that transmits the radio signal; that is, the addresses are assigned to respective portable terminals 5.

The controller 76 can estimate the number of persons in the detection target region α based on detailed information detected by the radiative temperature sensor 61. When the number of persons that is estimated based on an address or addresses that are included in a radio signal or signals received by the communication unit 75 is different from that estimated based on the detailed information, the controller 76 may adopt one of the estimated numbers or may adopt an average of the estimated numbers as the number of persons in the detection target region α.

The controller 76 controls the temperature in the room based on the estimated number of persons. For instance, when the number of persons in the detection target region α is larger than or equal to a predetermined number, the controller 76 may control, for example, the fan motor 70 or the compressor 30 to cause the temperature in the room to be lower than when the number of persons in the detection target region α is smaller than the predetermined number. When the number of persons in the detection target region α is smaller than the predetermined number of persons, the controller 76 may control, for example, the fan motor 70 or the compressor 30 to cause the temperature in the room to be higher than when the number of persons in the detection target region α is larger than or equal to the predetermined number. It should be noted that the indoor temperature is raised by the bodily temperature of a person, and in view of this point, the above control is performed and is intended to improve the comfort.

Figure 7:
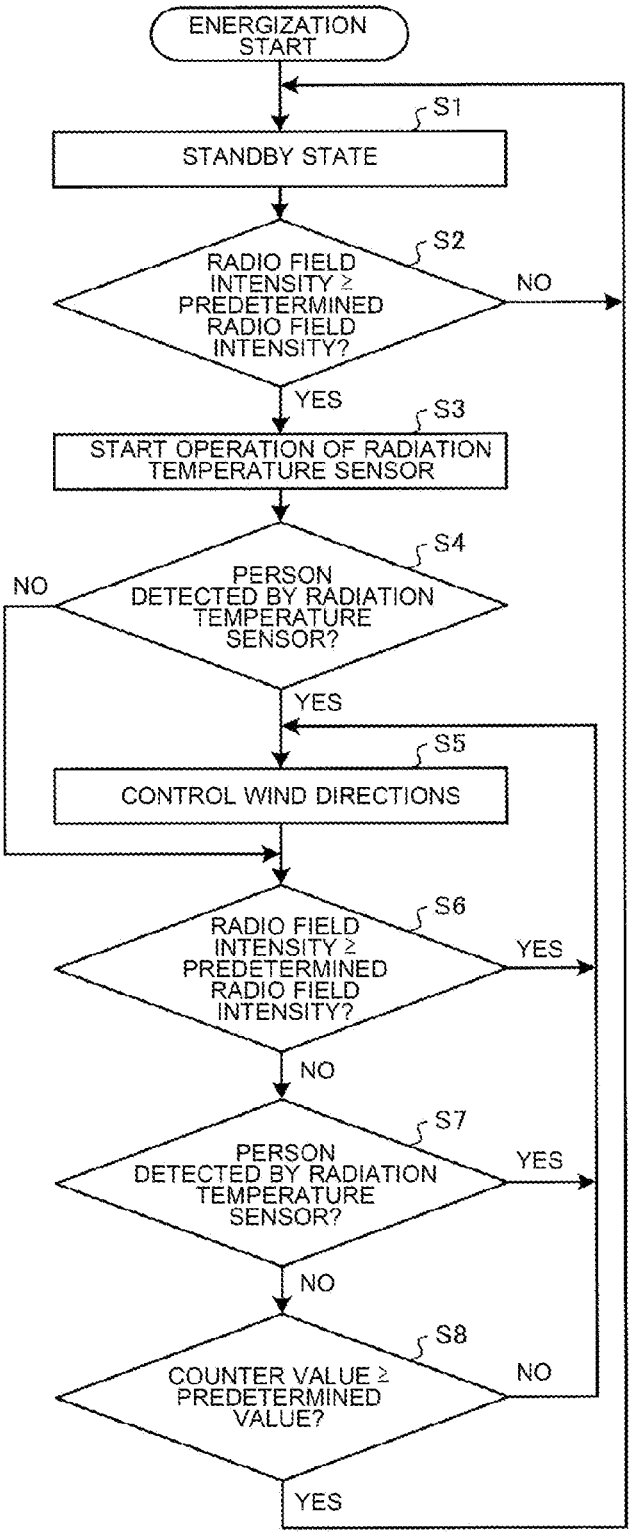
FIG. 7 indicates an example of a control process by a controller in an embodiment of the present disclosure.

FIG. 7 indicates an example of a control process by a controller in the embodiment of the present disclosure. In step S1, the air-conditioning apparatus 1 that has been energized enters a standby state. In this case, the radiative temperature sensor 61 is in a standby state and is not in operation. By contrast, when being energized, the communication unit 75 becomes able to receive a radio signal at all times.

In step S2, when the communication unit 75 does not receive a radio signal having a radio field intensity higher than or equal to the predetermined radio field intensity (No in step S2), the air-conditioning apparatus 1 is kept in the standby state in step S1. By contrast, in step S2, when the communication unit 75 receives a radio signal having a radio field intensity higher than or equal to the predetermined radio field intensity (Yes in step S2), in step S3, the controller 76 causes the radiative temperature sensor 61 to start to perform the operation (which will be also referred to as a detection process). In this case, the controller 76 sets a counter value to zero. This counter value is used in a process in step S8, which will be described later.

In step S4, the controller 76 determines whether the radiative temperature sensor 61 detects presence of a person in the detection target region α or not. In step S4, it is determined that the radiative temperature sensor 61 does not detect presence of a person (No in step S4), the process proceeds to step S6, which will be described later. It should be noted that the transition from step S4 to step S6 may be made after the detection process by the radiative temperature sensor 61 is executed for a given time period.

In step S4, when it is determined that the radiative temperature sensor 61 detects, for example, presence of a person (Yes in step S4), in step S5, the controller 76 controls the vertical wind direction control motor 73 and the lateral wind direction control motor 74 based on detailed information from the radiative temperature sensor 61. Under the above control, the orientations of the vertical wind direction control plates 71 and the lateral wind direction control plates 72 are adjusted and the flow direction of wind that is blown out from each of the air outlets 60 is adjusted as the wind direction, whereby air is sent or not sent to the small area β where the person is present (step S5). While adjusting the wind direction or after adjusting the wind direction, the air-conditioning apparatus 1 performs the air-conditioning operation. In this case, the controller 76 may perform a control of the air-conditioning operation (which will also be referred to as air-conditioning control) based on, for example, the number of persons in the detection target region α that can be estimated based on an address or addresses in a radio signal or radio signals that are received by the communication unit 75, the number of persons in the detection target region α that can be estimated from detailed information sent from the radiative temperature sensor 61, or an average of these numbers.

In step S6, the controller 76 determines whether or not the communication unit 75 receives a radio signal having a radio field intensity higher than or equal to the predetermined radio field intensity, during a given time t1 (also referred to as a first time t1) in which the air-conditioning control or the detection process is executed. In step S6, when it is determined that the communication unit 75 receives a radio signal having a radio field intensity higher than or equal to the predetermined radio field intensity, during the given time t1 (Yes in step S6), the process by the air-conditioning apparatus 1 returns to step S5. In this case, when the counter value is not zero, the controller 76 may update the counter value to change it to zero. In step S5 to which a transition is made from step S6, the radiative temperature sensor 61 may re-detect the position of a person.

In step S6, when it is determined that the communication unit 75 does not receive a radio signal having a radio field intensity higher than or equal to the predetermined radio field intensity, during the given time t1 (No in step S6), the controller 76 adds 1 to the counter value, and the process by the air-conditioning apparatus 1 proceeds to step S7.

In step S7, the controller 76 determines whether or not the radiative temperature sensor 61 detects presence of a person during a given time t2 (also referred to as a second time t2) in which the air-conditioning control or the detection process is executed. In step S7, when it is determined that the radiative temperature sensor 61 detects presence of a person during the given time t2 (Yes in step S7), the process by the air-conditioning apparatus 1 returns to step S5. In this case, when the counter value is not zero, the controller 76 may update the counter value to change it to zero. In step S5 to which a transition is made from step S7, the radiative temperature sensor 61 may re-detect the position of the person. Each of the given time t1 and the given time t2 is determined in advance.

In step S7, when the radiative temperature sensor 61 does not detect presence of a person during the given time t2 (No in step S7), the controller 76 adds 1 to the counter value, and the process by the air-conditioning apparatus 1 proceeds to step 8.

In step S8, the controller 76 determines whether or not the counter value is greater than or equal to a predetermined value. The predetermined value is a natural number greater than or equal to 2, and is, for example, 2. In step S8, when the counter value is less than the predetermined value (No in step S8), the process by the air-conditioning apparatus 1 returns to step S5. In step S5 to which a transition is made from step S8, the radiative temperature sensor 61 may re-detect the position of a person. In step S8, when it is determined that the counter value is greater than or equal to the predetermined value (Yes in step S8), the air-conditioning apparatus 1, under control by the controller 76, enters a standby state in step S1, that is, a state in which the air-conditioning operation is stopped. Accordingly, the operation of the radiative temperature sensor 61 is stopped.

In the air-conditioning apparatus 1 according to the embodiment of the present disclosure, when the communication unit 75 receives a radio signal of a radio field intensity higher than or equal to the predetermined radio field intensity, the controller 76 causes the radiative temperature sensor 61 that is in the stopped state to start to perform the operation. The controller 76 controls the air-conditioning operation of the air-conditioning apparatus 1 based on detailed information detected by the radiative temperature sensor 61. Because these processes are executed, the radiative temperature sensor 61 can start to perform the operation upon reception of a radio signal having a radio field intensity higher than or equal to the predetermined radio field intensity; that is, a trigger for starting the operation of the radiative temperature sensor 61 is reception of a radio signal having a radio field intensity higher than or equal to the predetermined radio field intensity. Therefore, the radiative temperature sensor 61 does not need to be continuously in operation. It is therefore possible to reduce deterioration of the radiative temperature sensor 61, and also to achieve energy saving without reducing the comfort for the person in the detection target region α.

In the air-conditioning apparatus 1 according to the embodiment of the present disclosure, the lowest radio field intensity of radio field intensities of radio signals that are sent from the portable terminal or terminals 5 that are held by a person or persons in the detection target region α is the predetermined radio field intensity. Thus, reception of a radio signal having a radio field intensity indicating the presence of a person in the detection target region α can be a trigger for starting the operation of the radiative temperature sensor 61. It is therefore possible to reduce the deterioration of the radiative temperature sensor 61 without reducing the comfort for the person in the detection target region α.

In the air-conditioning apparatus 1 according to the embodiment of the present disclosure, when the communication unit 75 receives a radio signal having a radio field intensity higher than or equal to the predetermined radio field intensity while the air-conditioning control or the detection process is being performed, the controller 76 causes the air-conditioning apparatus 1 to continue the air-conditioning operation without stopping the radiative temperature sensor 61, and performs the air-conditioning control based on detailed information. Therefore, it is possible to maintain the comfort for the person in the detection target region α.

In the air-conditioning apparatus 1 according to the embodiment of the present disclosure, the controller 76 stops the process by the radiative temperature sensor 61, when a sum of a value indicating the number of times the communication unit did not receive a radio signal having a radio field intensity higher than or equal to the predetermined radio field intensity for the first time t1 during execution of air-conditioning control or the detection process and a value indicating the number of times the radiative temperature sensor did not detect presence of a person in the detection target region α for the second time t2 is greater than or equal to the predetermined value. Because results of detection that is performed at a number of times using the communication unit 75 and the radiative temperature sensor 61 can be referred to, the controller 76 can accurately determine whether a person or persons are present or absent in the detection target region α or not without overlooking presence of a person or persons in the detection target region α when the persons are present therein; that is, the controller 76 can accurately determine absence of a person when no person is present in the detection target region α. When determining absence of a person in the detection target region α, the controller 76 causes the radiative temperature sensor 61 to be stopped, and also causes the air-conditioning operation to be stopped. It is therefore possible to avoid a wasted operation of the radiative temperature sensor 61, thus reduce deterioration of the radiative temperature sensor 61, and reduce unnecessary power consumption for air-conditioning In the air-conditioning apparatus 1 according to the embodiment of the present disclosure, the detailed information includes information indicating the position of a person or persons who are present in the detection target region α. Thus, the air-conditioning control can be performed in accordance with the position of the person and the comfort is therefore improved.

In the air-conditioning apparatus 1 according to the embodiment of the present disclosure, the detailed information includes information indicating a temperature distribution in the detection target region α. Thus, the air-conditioning control can be performed in such a manner as to vary from one location to another in the detection target region α, and the comfort is therefore improved.

In the air-conditioning apparatus 1 according to the embodiment of the present disclosure, the vertical wind direction control plates 71 and the lateral wind direction control plates 72 are adjusted based on the detailed information. It is therefore possible to generate current of wind in accordance with at least one of the position of the person and the temperature distribution in the air-conditioned space, and thus improve the comfort.

In the air-conditioning apparatus 1 according to the embodiment of the present disclosure, the controller 76 adjusts the vertical wind direction control plates 71 and the lateral wind direction control plates 72 in accordance with the operational state of the air-conditioning apparatus 1, as well as the detailed information. The air-conditioning operation can be performed in accordance with the states of components in the air-conditioning apparatus 1 without reducing the comfort.

In the air-conditioning apparatus 1 according to the embodiment of the present disclosure, the controller 76 performs the air-conditioning control based on information concerning at least one of the number of persons in the detection target region α that is derived from one or more identification information (addresses) included in one or more radio signals received by the communication unit 75 and the number of persons in the detection target region α that is derived from the detailed information. It is therefore possible to perform a temperature control depending on the number of persons in the air-conditioned space, and thus improve the comfort.

REFERENCE SIGNS LIST

1: air-conditioning apparatus, 2: refrigerant circuit, 3: outdoor unit, 4: indoor unit, 5: portable terminal, 9*a*, 9*b*: refrigerant pipe, 30: compressor, 31: flow switching device, 32: outdoor heat exchanger, 33: outdoor fan, 34: expansion valve, 40: indoor heat exchanger, 41: fan, 60: air outlet, 61: radiative temperature sensor, 62: housing, 63: decorative panel, 64: grille, 65: filter, 66: body air inlet, 67: body air outlet, 68: turbofan, 69: bell mouth, 70: fan motor, 71: vertical wind direction control plate, 72: lateral wind direction control plate, 73: vertical wind direction control motor, 74: lateral wind direction control motor, 75: communication unit, 76: controller, 620: top panel, 621: side panel, α: detection target region, β: small area, t1: first given time, t2: second given time

The invention claimed is:

1. An air-conditioning apparatus comprising:

a communication unit configured to receive a radio signal from a portable terminal;

a sensor configured to detect detailed information that includes information indicating presence or absence of a person in a detection target region that is a target region for detection of whether a person is present or not; and a controller configured to determine whether the communication unit receives a radio signal having a radio field intensity higher than or equal to a predetermined radio field intensity for triggering sensor operation and whether a detection process by the sensor to detect the detailed information is in a stopped state, responsive to determining that the radio signal having the radio field intensity is received and that the detection process is in the stopped state, cause the sensor to start the detection process to detect the detailed information and control an air-conditioning operation based on the detailed information detected by the sensor, after causing the sensor to start the detection process, determine whether the communication unit does not receive a radio signal having a radio field intensity higher than or equal to the predetermined radio field intensity and whether the sensor continuously detects no person in the detection target region, responsive to determining that the communication unit does not receive the radio signal and that the sensor continuously detects no person, cause the detection process by the sensor to be stopped.

2. The air-conditioning apparatus of claim 1, wherein the predetermined radio field intensity is a lowest radio field intensity of radio field intensities of radio signals received from the portable terminal held by a person present in the detection target region.

3. The air-conditioning apparatus of claim 1, wherein the controller is configured to determine whether the communication unit receives the radio signal having the radio field intensity higher than or equal to the predetermined radio field intensity while the air-conditioning operation is controlled or while the detection process is executed, in response to determining that the communication unit receives the radio signal having the radio field intensity higher than or equal to the predetermined radio field intensity while the air-conditioning operation is controlled or while the detection process is executed, cause the air-conditioning apparatus to continue the air-conditioning operation without stopping the detection process by the sensor, and control the air-conditioning operation based on the detailed information detected by the sensor.

4. The air-conditioning apparatus of claim 1, wherein the controller is configured to count a sum of the number of times the communication unit does not receive the radio signal having a radio field intensity higher than or equal to the predetermined radio field intensity for a first time during control of the air-conditioning operation or execution of the detection process and the number of times the sensor does not detect presence of a person in the detection target region for a second time during control of the air-conditioning operation or execution of the detection process, and in response to the sum being greater than or equal to a predetermined value, stop the detection process by the sensor and cause the air-conditioning apparatus to stop the air-conditioning operation.

5. The air-conditioning apparatus of claim 1, wherein in response to a person being present in the detection target region, the detailed information includes information indicating presence of the person in the detection target region.

6. The air-conditioning apparatus of claim 5, further comprising:

a vertical wind direction control plate configured to control an angle of a flow direction of wind relative to the floor surface, the wind being blown from the air-conditioning apparatus;

a lateral wind direction control plate configured to control the flow direction of the wind that is blown from the air-conditioning apparatus, in a direction parallel to the floor surface;

a vertical wind direction control motor configured to drive the vertical wind direction control plate; and a lateral wind direction control motor configured to drive the lateral wind direction control plate, wherein the controller controls the vertical wind direction control motor and the lateral wind direction control motor based on the detailed information.

7. The air-conditioning apparatus of claim 6, wherein the controller controls the vertical wind direction control motor and the lateral wind direction control motor based on the detailed information and an operational state of the air-conditioning apparatus.

8. The air-conditioning apparatus of claim 1, wherein the detailed information includes information indicating a temperature distribution in the detection target region.

9. An air-conditioning apparatus comprising:

a communication unit configured to receive a radio signal from a portable terminal;

a sensor configured to detect detailed information that includes information indicating presence or absence of a person in a detection target region that is a target region for detection of whether a person is present or not; and a controller configured to determine whether the communication unit receives a radio signal having a radio field intensity higher than or equal to a predetermined radio field intensity for triggering sensor operation and whether a detection process by the sensor to detect the detailed information is in a stopped state, responsive to determining that the radio signal having the radio field intensity is received and that the detection process is in the stopped state, cause the sensor to start the detection process to detect the detailed information and control an air-conditioning operation based on the detailed information detected by the sensor, wherein the radio signal includes an identification code that identifies the portable terminal on a transmission side that transmits the radio signal, after causing the sensor to start the detection process, derive a number of persons in the detection target region, from at least one of (i) one or more identification codes included in one or more radio signals received by the communication unit, and (ii) the detailed information detected by the sensor, and control the air-conditioning operation based on the number of persons in the detection target region.

10. The air-conditioning apparatus of claim 9, wherein the predetermined radio field intensity is a lowest radio field intensity of radio field intensities of radio signals received from the portable terminal held by a person present in the detection target region.

11. The air-conditioning apparatus of claim 9, wherein the controller is configured to determine whether the communication unit receives the radio signal having the radio field intensity higher than or equal to the predetermined radio field intensity while the air-conditioning operation is controlled or while the detection process is executed, in response to determining that the communication unit receives the radio signal having the radio field intensity higher than or equal to the predetermined radio field intensity while the air-conditioning operation is controlled or while the detection process is executed, cause the air-conditioning apparatus to continue the air-conditioning operation without stopping the detection process by the sensor, and control the air-conditioning operation based on the detailed information detected by the sensor.

12. The air-conditioning apparatus of claim 9, wherein the controller is configured to count a sum of the number of times the communication unit does not receive the radio signal having a radio field intensity higher than or equal to the predetermined radio field intensity for a first time during control of the air-conditioning operation or execution of the detection process and the number of times the sensor does not detect presence of a person in the detection target region for a second time during control of the air-conditioning operation or execution of the detection process, and in response to the sum being greater than or equal to a predetermined value, stop the detection process by the sensor and cause the air-conditioning apparatus to stop the air-conditioning operation.

13. The air-conditioning apparatus of claim 9, wherein in response to a person being present in the detection target region, the detailed information includes information indicating presence of the person in the detection target region.

14. The air-conditioning apparatus of claim 13, further comprising:

a vertical wind direction control plate configured to control an angle of a flow direction of wind relative to the floor surface, the wind being blown from the air-conditioning apparatus;

a lateral wind direction control plate configured to control the flow direction of the wind that is blown from the air-conditioning apparatus, in a direction parallel to the floor surface;

a vertical wind direction control motor configured to drive the vertical wind direction control plate; and a lateral wind direction control motor configured to drive the lateral wind direction control plate, wherein the controller controls the vertical wind direction control motor and the lateral wind direction control motor based on the detailed information.

15. The air-conditioning apparatus of claim 14, wherein the controller controls the vertical wind direction control motor and the lateral wind direction control motor based on the detailed information and an operational state of the air-conditioning apparatus.

16. The air-conditioning apparatus of claim 9, wherein the detailed information includes information indicating a temperature distribution in the detection target region.

* * * * *